US007617946B2

(12) United States Patent
Loerop et al.

(10) Patent No.: US 7,617,946 B2
(45) Date of Patent: Nov. 17, 2009

(54) TRANSPORTATION RING

(75) Inventors: Steven W. Loerop, Elmhurst, IL (US); Matthew E. Gleser, Park Ridge, IL (US); John P. Williams, Franklin Park, IL (US); Kenneth W. Loerop, Chicago, IL (US)

(73) Assignee: Bway Corporation, Atlanta, GA (US)

( * ) Notice: Subject to any disclaimer, the term of this patent is extended or adjusted under 35 U.S.C. 154(b) by 83 days.

(21) Appl. No.: 10/850,618

(22) Filed: May 21, 2004

(65) Prior Publication Data

US 2004/0232150 A1 Nov. 25, 2004

Related U.S. Application Data

(60) Provisional application No. 60/473,605, filed on May 22, 2003.

(51) Int. Cl.
*B65D 45/32* (2006.01)

(52) U.S. Cl. ..... 220/319; 220/733; 220/729; 220/700; 220/286

(58) Field of Classification Search ..... 220/319, 220/733, 729, 286, 700
See application file for complete search history.

(56) References Cited

U.S. PATENT DOCUMENTS 4,932,554 A * 6/1990 Smith et al. ..... 220/319
5,193,705 A * 3/1993 McCallum et al. ..... 220/319
6,142,330 A * 11/2000 Sacks ..... 220/23.6

* cited by examiner

*Primary Examiner*—Anthony Stashick
*Assistant Examiner*—Christopher B McKinley
(74) *Attorney, Agent, or Firm*—Morris, Manning & Martin LLP

(57) ABSTRACT

A unitary, removable, transportation ring for maintaining the closure of a covered container, such as a cylindrical paint can, snaps into place and securely maintains a lid on the container even in an environment of high pressure within the container. The ring is responsively operable in the presence of elevated and extreme pressures within the container to improve the engagement of the ring with the container, and to improve the engagement of the lid with the container, each in order to maintain the cover tightly sealed over the top opening of the container. An annular flange depends from the inner radial margin of the body of the ring and abuts the lid or cover of the container to maintain the engagement of the lid with the container.

24 Claims, 4 Drawing Sheets

Top Perspective View Ring from Patent Draftsperson

Top Perspective View Ring on Container from Patent Draftsperson

TRANSPORTATION RING

CROSS REFERENCES TO RELATED APPLICATIONS

This application claims the benefit under 35 U.S.C. § 119 (e) of U.S. Provisional Pat. No. 60/473,605, filed May 22, 2003, and entitled "Transportation Ring," which is incorporated herein by reference. This application also incorporates herein by reference the entirety of each of two United States patents, namely U.S. Pat. No. 5,193,705 to McCallum et al., issued Mar. 16, 1993, and entitled "Transportation Ring," and U.S. Design Pat. No. D 348,836 to McCallum et al., issued Jul. 19, 1994, and entitled "Transportation Safety Ring for Cylindrical Containers."

FIELD OF THE PRESENT INVENTION

This invention relates generally to transportation rings for containers, such as liquid-carrying, cylindrical containers including paint cans and the like and, more particularly, to an improved ring attachment for the upper end of such containers to promote safe transportation of the container and of liquids stored therein.

BACKGROUND OF THE PRESENT INVENTION

In the transportation and storage of materials such as chemicals, paints and toxic liquids, that may be both valuable and hazardous, it is imperative that the sealed integrity of a container be maintained. For example, the sealing cover or lid for a cylindrical paint container must be retained in sealing engagement with the container to avoid the loss of an investment, to prevent the inconvenience and expense of a clean-up, and, in some cases, to protect the environment and satisfy regulatory requirements. Measures must sometimes be adopted to prevent the loss of a seal and subsequent spillage that might otherwise be caused by the presence of an elevated relative pressure within a container. Elevated internal pressure or a pressure differential between the interior and exterior of a container can be associated with, for example, impact, indentation of the container, elevated temperatures, lengthy storage times, vibratory agitations, liquid vaporizations, chemical reactions, and altitude changes in transportation and storage.

The United Nations Committee on the transportation of dangerous goods prescribes certain regulations that provide common and uniform measuring systems for specifying packaging and container requirements to be applied internationally. In general such requirements differ from existing U.S. governmental regulations in that they are directed to container performance rather than to the specific type of materials used in the construction of a container. Such regulations include performance tests having to do with internal pressures of containers, such as cylindrical metal paint cans having removable friction locked lids or covers. In brief, these tests require a water-filled container with a cover in place to be subjected to predetermined internal pressures for specific testing durations. No leakage may occur during a test in order for the container to pass inspection and approval. In the case of a multi-friction fit paint container or its equivalent, the sealed container must withstand an internal pressure of 14.5 pounds per square-inch (psi), also approximately 100 Kilopascal, relative to the pressure of the exterior of the container, for a period of five minutes. A typical multi-friction fit container is not engineered to be a pressure vessel, and, without some modification, it will not generally comply with the United Nations test regulations.

A need therefore exists for an improved device that maintains the sealing engagement of a cover with a container. A need exists for such a device that retains a cover with a container subjected to a range of relative pressures within the container. The present invention meets these and other needs, as described hereinafter.

SUMMARY OF THE PRESENT INVENTION

In order to provide for material containment in compliance with regulations and to promote the safe and secure transporting and storing of materials within containers having friction fit covers, an improved transportation ring in accordance with the invention was developed. In brief, the present invention provides a generally rigid unitary transportation ring for use with containers, such as paint cans, for enabling the containers to withstand elevated and extreme internal pressures without leaking. In use, the ring is placed over the cover of a container, snaps into position gripping the top of the outer wall of the container, abuts the cover of the container, and maintains the sealing engagement of the cover to prevent displacement and spillage.

A preferred embodiment of the inventive transportation ring comprises a unitary substantially planar body defined within a circular outer extent, an outer limb depending from the body adjacent the outer extent for engaging a roll extending radially from the upper end of a container, an inner limb depending from the body for passage into a channel defined by a cover seated with the container, and an inventive inner flange for abutting a portion of the lid that is radially inward of the channel. Optionally, a raised platform on the upper face of the body of the ring is provided for the convenient stacking of containers coaxially, one on top of the other.

It is an object of the invention to maintain a friction fit cover in sealing engagement with a container in a range of pressure conditions. The preferred embodiment of the inventive ring abuts and retains the cover of a container having no or moderate relative pressure therein. Furthermore, the invention is responsively operable in the presence of elevated and extreme pressures within the container to improve the engagement of the ring with the container, and to improve the engagement of the cover with the container, each in order to maintain the cover tightly sealed over the upper end of the container.

It is a particular object of the invention to provide a containment system able to withstand a relative internal pressure of at least 14.5 (psi) for a period of five (5) minutes without leaking.

The above and other objects, features, and advantages will be recognized by those of skill in the art from the following descriptions and accompanying drawings detailing and illustrating exemplary embodiments of the invention.

BRIEF DESCRIPTION OF THE DRAWINGS

Further features and benefits of the present invention will be apparent from a detailed description of preferred embodiments thereof taken in conjunction with the following drawings, wherein similar elements are referred to with similar reference numbers, and wherein.

DETAILED DESCRIPTION OF PREFERRED EMBODIMENTS

The above and further objects, features, and advantages of this invention will be recognized from the following detailed descriptions and drawings of particular embodiments of an improved transportation ring.

Turning now to a conventional, cylindrical container and cover illustrated in FIGS. 1A-1B, and to descriptions of a preferred embodiment of the present invention with references to FIGS. 2-4, it will be recognized that the hereinafter described embodiment relates to a removable transportation ring for use, preferably, with a cylindrical container having a friction-fit lid or cover for enclosing the open upper end of the container. An exemplary such container is the familiar and ubiquitous one-gallon paint can, although other containers of other volumes and constructions stand to benefit from the present invention and are within the scope of the descriptions herein. In particular, although the present invention is described in relation to a cylindrical container, it should be understood that non-cylindrical containers having a lid or any container having a top that is non-cylindrical are within the scope of the present invention and stand to benefit from the invention disclosed herein.

Figure 1A:
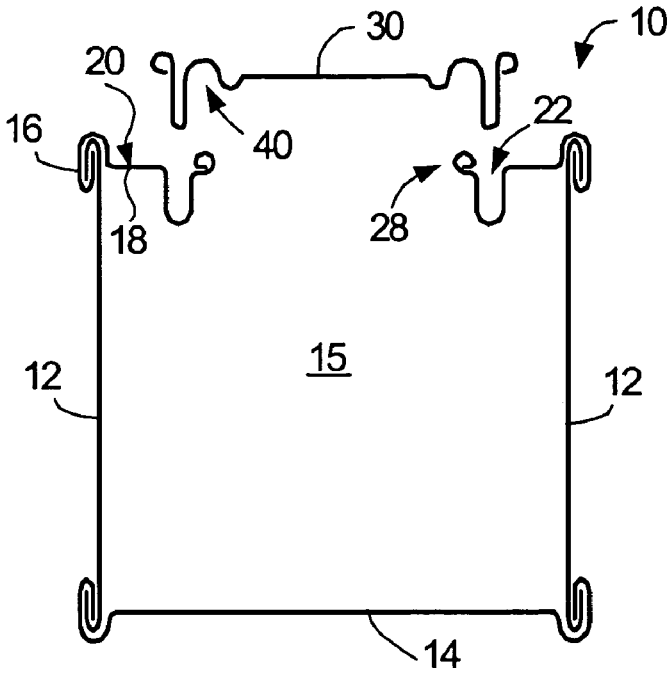
FIG. 1A is cross-sectional front elevational view of a container and cover disengaged.
Figure 1B:
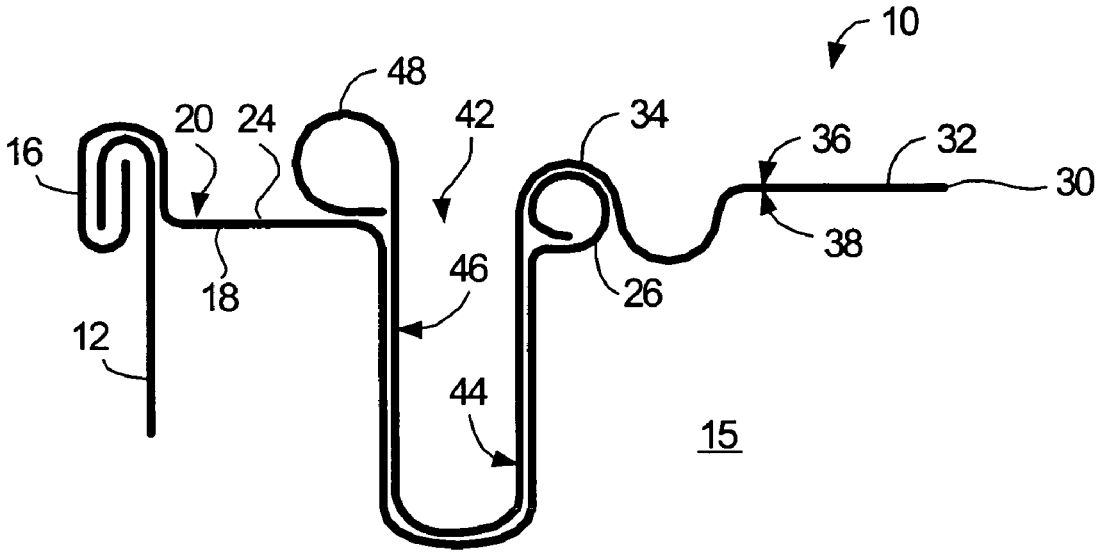
FIG. 1B is a partial cross-sectional view of the container and cover of FIG. 1A in engagement.

As shown in FIG. 1A in a cross-sectional diameter view and in FIG. 1B in a partial cross-sectional diameter view, a conventional cylindrical container 10, with which a preferred embodiment of the present invention is intended for use, includes a continuous cylindrical sidewall 12 having a lower margin joined with the radially outer margin of a transversely extending base 14 to define a vessel having an interior 15. At the upper end of the container, the upper margin of sidewall 12 is joined to the radially outer margin of an annular rim flange 18. In FIGS. 1A-1B, the sidewall 12 is joined with the rim flange 18 by a toroidal roll 16 formed by rolling the upper margin of the sidewall with the outer margin of the annular flange to form a fluid-sealing rim bead in a known manner. The roll 16 defines the upper and radially outer margin of the container 10. Other union forming sealing junctions, such as welds, can be utilized. Alternative containers, not illustrated, of unitary construction may be manufactured by techniques, such as mold injection and are also within the scope of use with the present invention.

The rim flange 18 has a surface 20 exterior to the vessel, which defines or includes a U-shaped annular locking channel 22. As illustrated in FIG. 1B, a planar platform portion 24 of the container intervenes between the roll and the channel. The radially inner edge of the rim flange terminates in a annular scroll 26 or folded bead which defines a circular opening 28 (FIG. 1A) in the top of the container 10 that is adapted to be sealed over by a removable cover 30 or lid. It will be noted that in the illustrated exemplary container, the scroll portion 26 of the rim flange 18 lies substantially opposite the roll 16.

Cover 30 comprises a generally circular, disc-like member having a planar central portion 32 bounded by an upwardly raised annular ridge 34 extending outwardly from the container from the exterior surface 36 of the cover 30. The exemplary cover 30 comprises a unitary shaped construction of substantially uniform material thickness and can be protected at its exterior surface 36 and at its interior surface 38 by a protective layer or treatment in conventional manner.

Opposing and corresponding to the annular ridge 34 and defined in the interior surface 38 of the cover 30 is an interior channel 40 (FIG. 1A) that is configured to receive the scroll 26 of the rim flange 18. The annular ridge 34 is integrally merged at its radially outer edge into an open annular channel 42 having a radially inner wall 44 and a radially outer wall 46 disposed in substantially parallel spaced relationship and which merge at their lower ends in an arcuate annular trough. The outer upper terminal edge of wall 46 is rolled outwardly into a circular scroll 48 that opposes ridge 34 across channel 42.

The spacing between the inner and outer walls 44 and 46 of the described cover configuration is such that the annular channel 42 of the cover is adapted to fit tightly within the underlying locking channel 22 (FIG. 1A) of the rim flange 18, as shown in FIG. 1B. The tight fit effects a close fitting, frictional interlocking seal between the cover and container for purposes of sealing liquid contents within container 10 in a manner referred to herein as a multi-friction fit.

A container, such as a one gallon paint can of the type illustrated, usually incorporates a handle or bail pivotal about trunnion posts or the like extending outwardly of the side walls of the container (not shown herein) of familiar and known structure. A typical container 10 is made of rolled and formed sheet metal, such as coated or corrosion resistant steel, although other constructions and materials are suitable for containers to which the present invention can be applied.

Figure 2A:
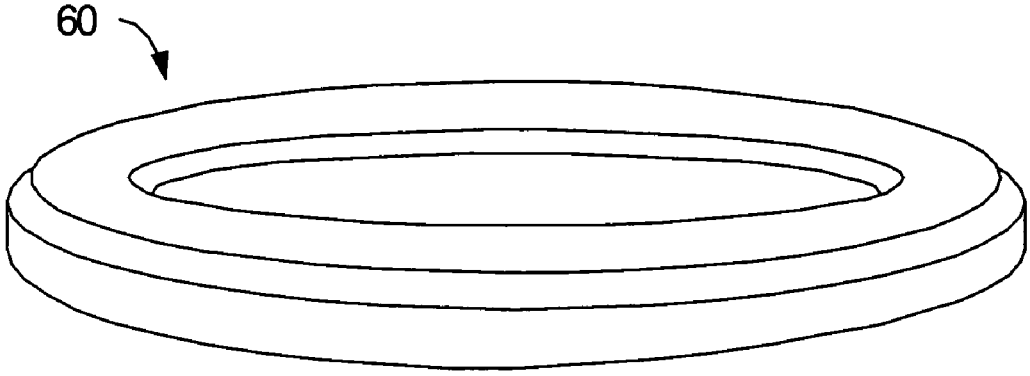
FIG. 2A is a top perspective view of an exemplary embodiment of an improved transportation ring according to the present invention.
Figure 2B:
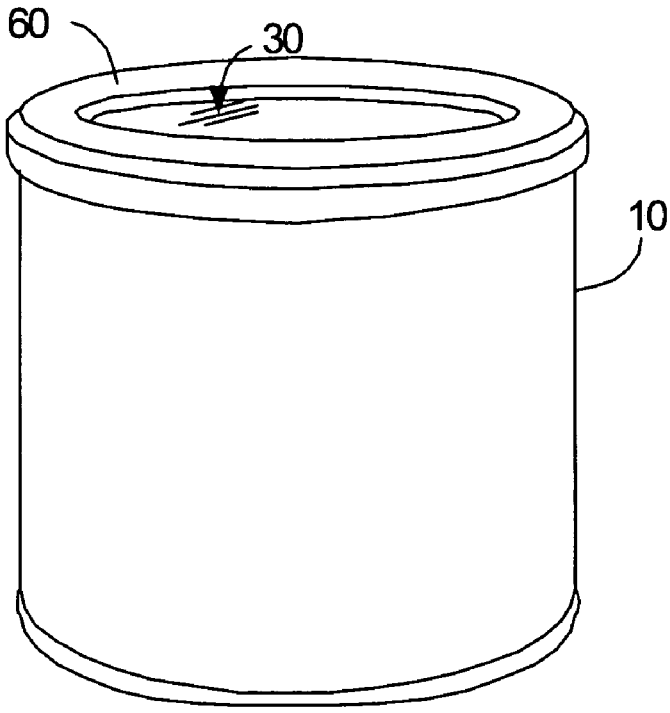
FIG. 2B is a top perspective view of the ring of FIG. 2A placed in engagement with the container of FIG. 1A.

A preferred embodiment of the improved transportation ring 60 of the present invention, as illustrated in FIG. 2A, comprises a rigid yet resilient, unitary annular member or ring. The ring 60 can be constructed by any suitable means, for example, by molding high-density polyethylene or similar plastic material having high tensile impact resistance. In FIG. 2B, the transportation ring is operationally mounted over the outer radial and upper margin of a container 10 for purposes of retaining the cover 30 in its frictionally sealed engagement with the container. The ring 60 is constructed to retain the cover 30 on the container in the presence of elevated relative internal pressures within the container, and to withstand external forces or blows against the top of the container.

Figure 3A:
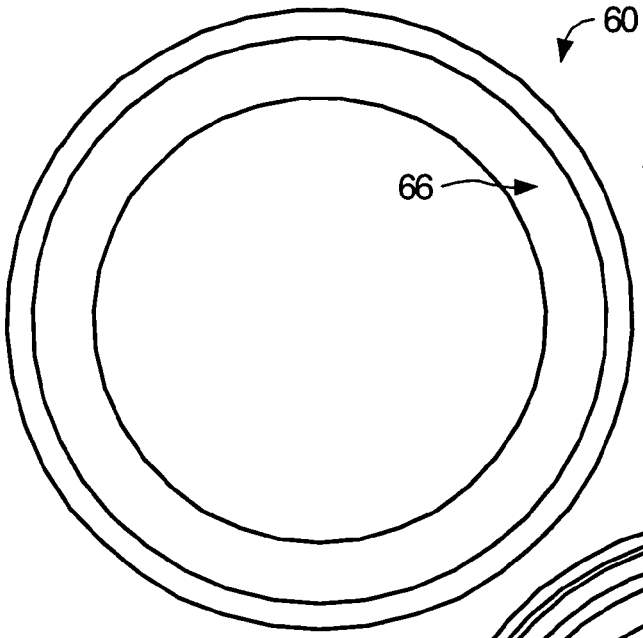
FIG. 3A is a top plan view of the ring of FIG. 2A.
Figure 3B:
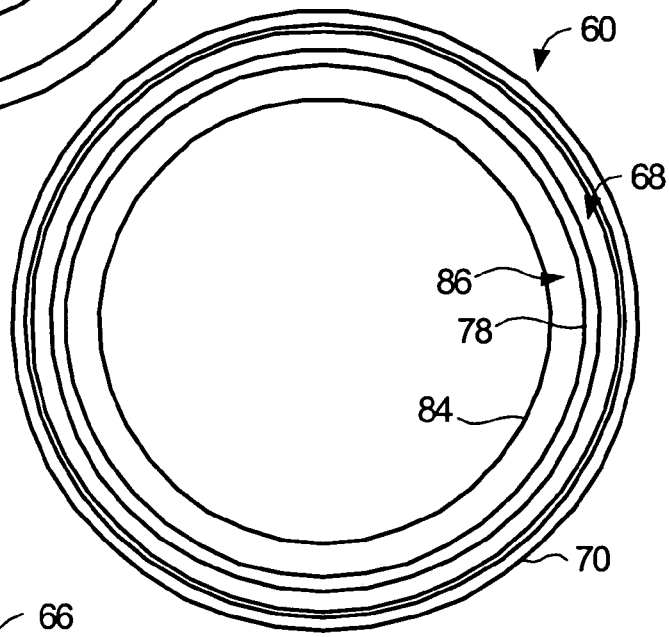
FIG. 3B is a bottom plan view of the ring of FIG. 2A.
Figure 3C:
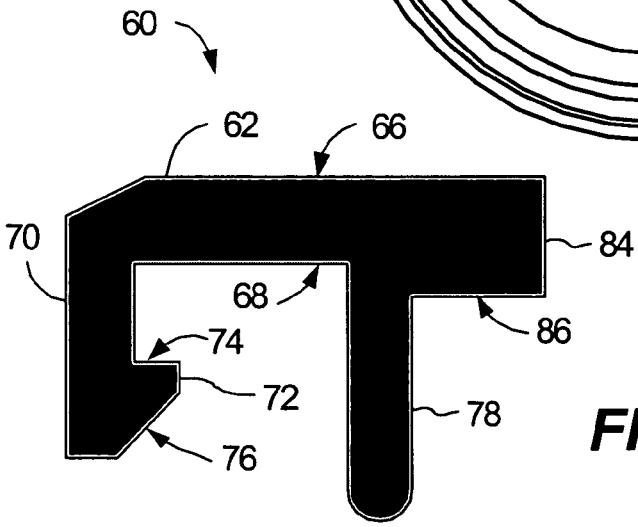
FIG. 3C is a bottom plan view of the ring of FIG. 2A.

A preferred embodiment of the improved transportation ring 60 according to the present invention is illustrated in top and bottom plan views, respectively, in FIGS. 3A and 3B and in partial cross-sectional view in FIG. 3C. The ring 60 comprises a generally annular planar body portion 62, an annular outer limb 70, an annular locking finger 72, an annular inner limb 78, and an annular flange 84.

As shown in FIG. 3C, the body 62 has an upper surface 66 and a lower surface 68. The lower surface 68 generally faces a container with which the ring 60 is engaged when in use.

The annular outer limb 70 depends from the outer radial margin of the body 62 extending away the lower surface 68. The annular locking finger 72 depends radially inwardly from the lower margin of the outer limb 70. The locking finger 72 is defined, in part, by an annular locking surface 74, and by an inclined, chamfered, or frustoconical guide surface 76.

The annular inner limb 78 depends from the inner radial margin and lower margin of the body 62, extends away from the lower surface 68, and is substantially parallel to the outer limb 70. As will be described in greater detail in association with FIGS. 4A, 4B, and 4C. The inner limb 78 is configured and positioned to be received by the annular channel of a cover when the ring is positioned in locking engagement with a covered container.

The annular flange 84 depends from the radially inner margin of the body 62 and is formed integrally therewith. The annular flange 84 is defined in part, as a lower margin, by an abutting surface 86 for contacting a cover when the ring is positioned in locking engagement with a covered container, and, in a preferred embodiment of the ring, for maintaining an application of force upon the cover when so engaged.

It will be apparent that the dimensions of the elements of the ring 60 are illustrated and are selected as suitable for use with the container 10 (FIG. 2B). The relative and absolute dimensions of the container 10 are not limited in these descriptions, and thus, no particular absolute or relative scale is explicitly provided or implied for the dimensions of the elements of the ring.

In order to position the ring 60 into locking engagement with a container (for example, see FIG. 2B), the ring is mounted over the upper margin of the container and pressed into position. In the process of mounting the ring, illustrated as completed in FIG. 4A, the inner limb 78 passes into the channel 42 and the guiding surface 76 contacts the upper and radially outer margin of the container. As force is applied uniformly or piecewise selectively to the upper surface 66 of the ring by a user (not illustrated), elasticity in the material of the ring allows slight stretching of the outer limb 70 and slight deformation of the ring in general, which enables the locking finger 72 to pass around, and then below, the outward radial extension or lip that depends from the top edge of the container proximal the upper margin of the sidewall 12. Although, the outward radial extension is defined in the exemplary container 10 by the toroidal roll 16, other container constructions provide alternative extensions.

Figure 4A:
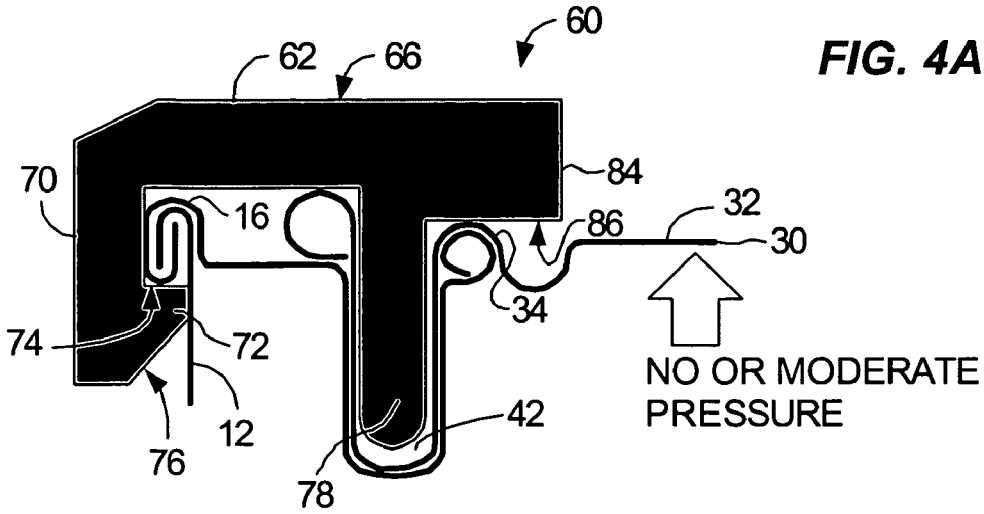
FIG. 4A is a partial cross-sectional view of the ring and container of FIG. 2B.

Resilience in the material of the ring 60 provides that the locking finger 72 snaps into place, as illustrated in FIG. 4A, defining a secure locking engagement of the ring with the container. With the ring securely engaged with the container, the locking surface 74 contacts and engages the lower margin of the extension or roll 16, and the abutting surface 86 of the annular flange 84 contacts the annular ridge 34 of the cover 30.

Figure 4B:
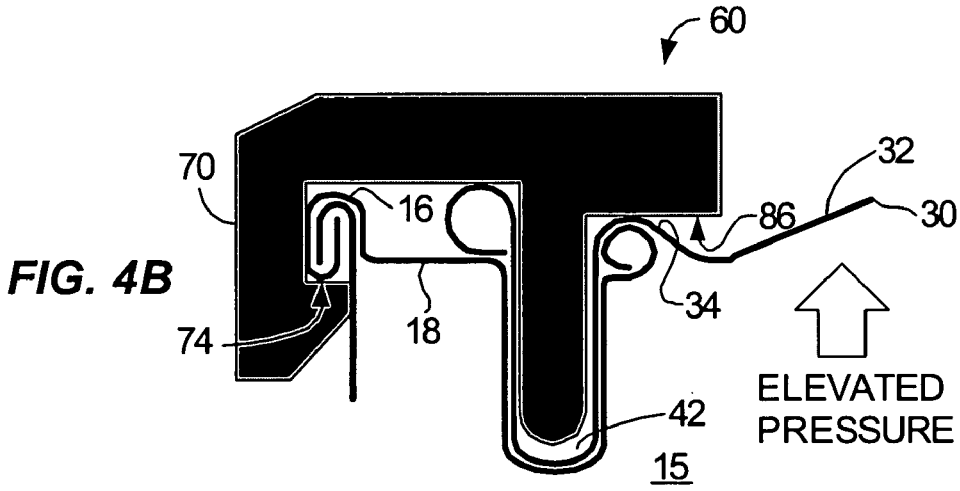
FIG. 4B is a partial cross-sectional view of the ring of FIG. 2A maintaining the engagement of a cover with a container having elevated internal pressure.

In FIG. 4B, the interior 15 of the container is subjected to an elevated internal pressure that, were it not for the locking engagement of the ring with the container, might disrupt the seal between the cover 30 and the rim flange 18 or might completely detach the cover from the container. The elevated pressure causes a distortion of the otherwise planar portion 32 of the cover and conveys forces to the ring 60 by way of, at least in part, the annular region where the ridge 34 of the cover contacts the abutting surface 86 of the annular flange 84. Such forces are opposed to retain the cover in place by, at least in part, the engagement of the locking surface 74 with the extension or roll 16. The abutting surface 86 of the illustrated preferred embodiment abuts and bears force down upon the cover to maintain the cover in sealing engagement with the container.

Figure 4C:
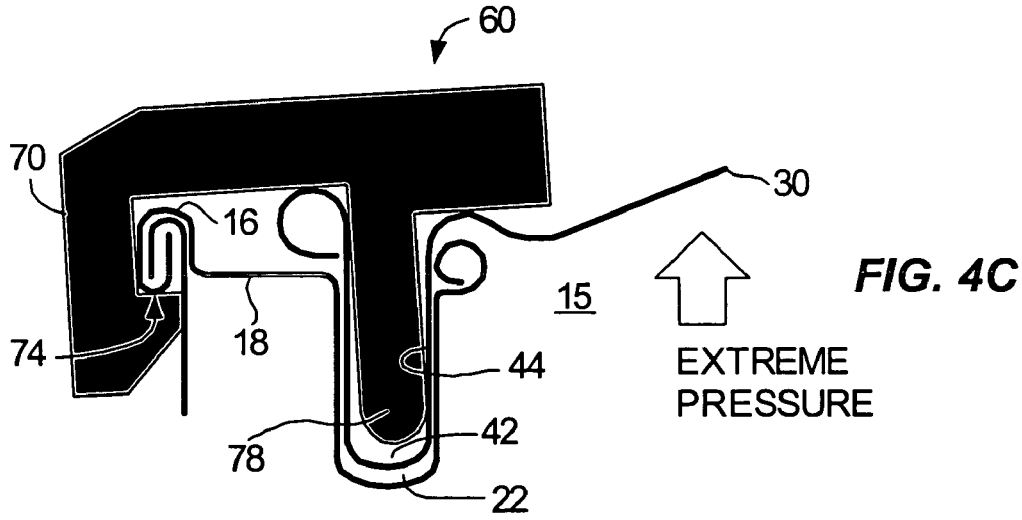
FIG. 4C is a partial cross-sectional view of the ring of FIG. 2A maintaining the engagement of a cover with a container having extreme internal pressure.

In FIG. 4C, the interior 15 of the container is subjected to an extreme internal pressure causing distortions of both the cover 30 and the ring 60. Forces are conveyed to the ring causing the distortion thereof such that the locking surface 74 inclines to grip, hook, or increase its engagement with the extension or roll 16. This responsive operation of the ring provides for increasing engagement of the ring with the container as the pressure in the interior of the container increases.

Furthermore, as illustrated in FIG. 4C, because forces conveyed to the ring cause distortions thereof including inclination, or skewing of the inner limb 78 disposed within the annular channel 42, forces are conveyed to increase the frictional interlocking seal between the cover and the container. Specifically, for example, the radially inner surface of the inner limb 78 contacts the inner wall 44 of the annular channel 42 and conveys therethrough a force to the inner wall of the locking channel 22 of the rim flange 18, thereby increasing the frictional engagement of the cover with the rim flange. This responsive operation of the ring provides for increasing engagement of the cover with the container as the pressure in the interior of the container increases.

Furthermore, the annular flange 84 provides structural support to the rigidity of the ring. The flange can also provide that when the ring is pressed into locking engagement with the container with the finger 72 engaged with the roll 16, the abutting surface 86 contacting the cover conveys a force to oppose any upward movement of the cover relative to the rim flange prior to, and separate from, any occurrence of elevated pressure within the interior of the container. The ring can thereby provide full-time prevention from upward movement of the cover and disengagement of the cover with the rim flange.

As stated previously, the present invention has been described primarily in relation to a cylindrical container, such as a paint can. Nevertheless, it will be understood by those skilled in the art that the present invention may also be used with any other shaped (non-cylindrical) container and still be within the scope of the present invention.

Accordingly, it will be readily understood by those persons skilled in the art that, in view of the above detailed description of the preferred embodiments and articles of the present invention, the present invention is susceptible of broad utility and application. Many methods, embodiments, and adaptations of the present invention other than those herein described, as well as many variations, modifications, and equivalent arrangements will be apparent from or reasonably suggested by the present invention and the above detailed description thereof, without departing from the substance or scope of the present invention. Accordingly, while the present invention is described herein in detail in relation to preferred embodiments, it is to be understood that this detailed description is only illustrative and exemplary of the present invention and is made for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention. The scope of the present invention is defined solely by the claims appended hereto and the equivalents thereof.

What is claimed is:

1. A ring for maintaining the closure of a cylindrical container, the cylindrical container including a rim flange attached to the upper end of the container around the circumference of the container and extending radially inwardly therefrom, said rim flange defining an annular locking channel depending downwardly from the rim flange for receiving an annular channel of a container lid adapted to fit within the locking channel for sealing engagement between the lid and container, the lid having an annular ridge extending upwardly from the lid, the ring comprising:

an annular body;

an annular outer limb depending downwardly from the body;

an annular locking finger extending radially inwardly from the outer limb;

an annular inner limb depending downwardly from the body; and an annular flange extending in a radially-inward direction from the inner limb, the annular flange having an axial thickness greater than a thickness of the annular body, the axial thickness being uniform along the radially-inward direction;

whereby when in use the ring engages the cylindrical container such that the annular locking finger engages an outer circumference of the rim flange, the annular inner limb depends into the annular channel, and the annular flange contacts the lid at the annular ridge of the lid radially inwardly of the annular channel of the lid to maintain closure between the container and lid.

2. The ring of claim 1, wherein the outer limb and inner limb are substantially parallel.

3. The ring of claim 1, wherein the outer limb depends from the outer margin of the annular body.

4. The ring of claim 1, wherein the locking finger is defined by a locking surface extending radially inwardly and by a chamfered guide surface for guiding the finger to pass around a lip on the outer circumference of the rim flange until the locking surface engages the lip as the ring is positioned to engage the container.

5. The ring of claim 1, wherein, in the presence of pressure sufficient to force distortion of the lid outwardly from the interior of the container, the engagement of the locking finger with the lip increases with the force of the distortion.

6. The ring of claim 5, wherein, in the presence of the sufficient pressure, the inner limb applies a force to the annular channel thereby increasing the engagement of the lid with the container.

7. The ring of claim 1, wherein the ring is an integral member of generally rigid, resilient high impact plastic.

8. The ring of claim 1, wherein the annular flange includes an abutting surface for contacting with the lid, whereby the axial thickness of the annular flange is thick enough such that the abutting surface contacts the lid when placed in engagement with the container to maintain placement of the lid.

9. A device for maintaining closure of a container having a lid, the container defining a lip at the top edge of the container and a rim flange extending inwardly from the lip towards the center of the container, the rim flange including a locking channel for receiving the lid, the lid defining a lid channel around the perimeter of the lid for engaging the locking channel, the device comprising:

a body adapted to fit on top of the container;

an outer limb depending from the body;

a locking finger member extending inwardly from the outer limb towards a central vertical axis of the body;

an inner limb depending from the body and adapted to fit within the lid channel; and an interior flange extending inwardly from the inner limb of the body towards the central vertical axis of the body and depending downwardly from the body continuously along the length of the interior flange, wherein the interior flange is adapted to contact an upwardly-extending portion of the lid disposed inwardly from the lid channel;

whereby when in use the outer limb extends about the lip of the container, the locking finger member engages the lip of the container, the inner limb extends into the lid channel, and the interior flange contacts the upwardly-extending portion of the lid disposed inwardly from the lid channel to maintain closure between the container and lid.

10. The device of claim 9, wherein, in the presence of pressure sufficient to force distortion of the lid outwardly from the interior of the container, the engagement of the locking finger with the lip increases with the force of the distortion.

11. The device of claim 9, wherein, in the presence of pressure sufficient to force distortion of the lid outwardly from the interior of the container, the inner limb applies a force to an inner wall of the lid channel thereby increasing the engagement of the lid with the container.

12. The device of claim 9, wherein the lip of the container comprises a toroidal roll of an upper margin of a sidewall of the container with an outer margin of the rim flange of the container, wherein the device maintains closure of the container by maintaining engagement of the lid with the rim flange of the container.

13. The device of claim 9, wherein the interior flange comprises an abutting surface for contacting the upwardly-extending portion of the lid.

14. The device of claim 9, wherein the container is cylindrical and the device is annular.

15. The device of claim 9, wherein the locking finger is annular and engages the lip about the circumference of the container.

16. A containment system comprising:

a cylindrical container having an outward radial lip at its top edge and a rim flange extending radially inwardly from the top edge, the rim flange including a downwardly depending locking channel;

a lid adapted to fit onto the top surface of the rim flange of the container, the lid including an annular channel for sealing engagement with the locking channel and an annular ridge disposed radially inwardly of the locking channel and extending upwardly from the upper surface of the lid; and a ring for maintaining closure of the lid with the container under pressure conditions, wherein the ring has a central axis, comprising:

an annular body;

an annular outer limb depending from the body and passing around the lip of the container;

an annular locking finger extending radially inwardly from the outer limb and engaging the lip of the container;

an annular inner limb depending from the body for engaging the annular channel defined in the upper surface of the lid; and an annular flange depending downwardly from the body in a direction parallel to the central axis of the ring and extending therefrom radially inwardly of the annular inner limb and contacting the upper surface of the annular ridge of the lid.

17. The containment system of claim 16, wherein, in the presence of pressure sufficient to force distortion of the lid outwardly from the interior of the closed container, the engagement of the locking finger with the lip and a force of engagement between the inner limb and an interior wall of the annular channel increases with the force of the distortion.

18. A ring for maintaining the closure of a cylindrical container, the cylindrical container including a rim flange attached to the upper end of the container around the circumference of the container and extending radially inwardly therefrom, said rim flange defining an annular locking channel depending downwardly from the rim flange for receiving an annular channel of a container lid adapted to fit within the locking channel for sealing engagement between the lid and container, the ring comprising:

an annular body;

an annular outer limb depending downwardly from the body;

an annular locking finger extending radially inwardly from the outer limb;

an annular inner limb depending downwardly from the body; and an annular flange extending from the body radially inwardly from an inward-facing surface of the annular inner limb, the annular flange having a relative thickness greater than the thickness of the annular body such that an abutting surface of the annular flange depends downwardly below the bottom surface of the annular body, the relative thickness of the annular flange being uniform along its extent;

whereby when in use the ring engages the cylindrical container such that the annular locking finger engages an outer circumference of the rim flange, the annular inner limb depends into the annular channel, and the abutting surface of the annular flange contacts the lid radially inwardly of the annular channel to maintain closure between the container and lid.

19. The ring of claim 18, wherein the outer limb and inner limb are substantially parallel.

20. The ring of claim 18, wherein the outer limb depends from the outer margin of the annular body.

21. The ring of claim 18, wherein the locking finger is defined by a locking surface extending radially inwardly and by a chamfered guide surface for guiding the finger to pass around a lip on the outer circumference of the rim flange until the locking surface engages the lip as the ring is positioned to engage the container.

22. The ring of claim 18, wherein, in the presence of pressure sufficient to force distortion of the lid outwardly from the interior of the container, the engagement of the locking finger with the lip increases with the force of the distortion.

23. The ring of claim 22, wherein, in the presence of the sufficient pressure, the inner limb applies a force to the annular channel thereby increasing the engagement of the lid with the container.

24. The ring of claim 18, wherein the ring is an integral member of generally rigid, resilient high impact plastic.

* * * * *